United States Patent [19]

Nagai et al.

[11] Patent Number: 4,808,053

[45] Date of Patent: Feb. 28, 1989

[54] APPARATUS FOR MAKING A NECKED-IN CONTAINER WITH A DOUBLE SEAM ON CONTAINER COVER

[75] Inventors: Katsumi Nagai, Ohmiya; Akio Shinjyo, Ageo, both of Japan

[73] Assignee: Hokkai Can Co., Ltd., Tokyo, Japan

[21] Appl. No.: 17,552

[22] Filed: Feb. 24, 1987

[30] Foreign Application Priority Data

Feb. 25, 1986 [JP] Japan ..... 61-25161[U]

[51] Int. Cl.[4] ..... B21P 51/30

[52] U.S. Cl. ..... 413/30; 413/27

[58] Field of Search ..... 413/3, 4, 6, 26, 27, 413/30, 31, 37, 43, 44, 45, 50, 52

[56] References Cited

U.S. PATENT DOCUMENTS

| | | | |
|---|---|---|---|
| 1,548,743 | 8/1925 | Powell | 413/30 |
| 1,929,339 | 10/1933 | Troger et al. | 413/27 |
| 2,727,481 | 12/1955 | Laxo | 413/45 |
| 2,975,740 | 3/1961 | Smith et al. | 413/45 |
| 4,270,475 | 6/1981 | Fletcher et al. . | |

*Primary Examiner*—Frederick R. Schmidt

*Assistant Examiner*—Robert Showalter

*Attorney, Agent, or Firm*—Birch, Stewart, Kolasch & Birch

[57] ABSTRACT

A barrel and a cover, to be combined into a container, are rotated by a preliminary machining feeder while they are supported by a first rotatable seaming chuck and a first holder. During rotation of the preliminary machining feeder, a flange of the barrel and an end hook of the cover are pressed by a first seaming segment against the first seaming chuck, so that the barrel and the cover are preliminarily fastened and necked in. The barrel and the cover are then transferred by a transfer unit to a final machining feeder on which the barrel and the cover are supported by a second rotatable seaming chuck and a second holder. The final machining feeder is rotated to feed the barrel and the cover while they are finally fastened and necked in by a second seaming segment. The first and second seaming segments are arcuate in shape and have their inner shaping surfaces progressively approaching the preliminary and final machining feeders, respectively, in the direction of rotation thereof.

8 Claims, 6 Drawing Sheets

APPARATUS FOR MAKING A NECKED-IN CONTAINER WITH A DOUBLE SEAM ON CONTAINER COVER

BACKGROUND OF THE INVENTION

1. Field of the Invention

The present invention relates to an apparatus for manufacturing a container including a barrel with an open end thereof closed by a cover having a peripheral edge fastened to the peripheral edge of the barrel open end, the barrel having a necked-in portion.

2. Description of Background Art

One general metallic container includes a barrel of metal having an open end thereof closed by a cover of metal having a peripheral edge thereof fastened to the peripheral edge of the open end of the barrel to form a double seam. The barrel is necked in to provide a necked-in portion adjacent to the double seam.

Japanese Laid-Open Patent Publication No. 58-35027 discloses a method of making such a container with a conventional apparatus by fastening a container barrel and a cover together into a double seam and simultaneously necking in the container barrel. The disclosed method is shown in FIGS. 10 and 11(A) through 11(C). As shown in FIG. 11(A), a metallic container cover b includes a chuck wall c having an outside diameter smaller than the inside diameter of an open end of a metallic container barrel a. First, the chuck wall c is fitted in the open end of the barrel a. A rotatable seaming chuck d with its diameter equal to the inside diameter of the chuck wall c is mounted on the cover b with the outer side wall of the seaming chuck d being held against the inner surface of the chuck wall c. Then, as illustrated in FIGS. 10 and 11(B), a first seaming roll e is pressed against the barrel a and the chuck wall c toward the seaming chuck d for preliminarily fastening a flange i of the barrel a and an end hook h of the cover b. At the same time, the barrel a is preliminarily necked in by a shoulder or jaw f of the first seaming roll e, thus forming a necked-in portion j. Thereafter, a second seaming roll g is pressed against the preliminarily fastened end hook h and the flange i to fasten them to each other while deforming them toward the chuck wall c, thereby perfecting the necked-in portion j and providing a double seam k.

In the above method, it is important that the first seaming roll e and the second seaming roll g be moved toward the seaming chuck d for accurately selected distances and under exactly adjusted pressures when the barrel a and the cover b are fastened together. In recent years, the barrel a and the cover b are made of a highly hard material such as tin-free sheet steel and fastened to each other at high speed. Unless the distances and pressures were well selected and adjusted for the rolls e, g, the necked-in portion j would have wrinkles 1 as shown in FIG. 10 at X, the double seam k would not sufficiently be fastened, and the necked-in portion j would have an irregular outer shape. More specifically, the cover b as it is rotated during the fastening process is subjected to high resistance against forced deformation thereof, and the roll e or g and the cover b are pressed against each other through an extremely small area. Therefore, if the distance of movement of the roll e or g or the pressure applied thereto were varied, the necked-in portion j would tend to produce the wrinkles 1 as illustrated in FIG. 10, or the roll e or g and the cover b might slip with respect to each other. As a result, the barrel a and the cover b would not be well fastened together in the double seam k. The irregular profile of the necked-in portion j would result in an impaired appearance of the produced container. The rolls e and g would be apt to undergo rapid wear because of the slippage during the fastening process, and could not be used for a long period of time.

SUMMARY OF THE INVENTION

In view of the aforesaid shortcomings of the conventional container manufacturing apparatus, it is an object of the present invention to provide an apparatus for making a container while allowing a barrel and a cover to be firmly fastened in a double seam and simultaneously forming a necked-in portion of prescribed shape on the barrel.

According to the present invention, there is provided an apparatus for manufacturing a container including a barrel having an open end with a flange and a cover having a panel. A cylindrical chuck wall is raised from the panel and has an outside diameter smaller than the inside diameter of the barrel, and an end hook is contiguous to the chuck wall. The chuck wall is inserted in the open end of the barrel. The flange and the end hook are fastened by a double seam. The barrel and the cover are necked in adjacent to the double seam. The apparatus include a rotatable preliminary machining feeder including a plurality of first rotatable seaming chucks spaced circumferentially and radially equally from a center of rotation of the preliminary machining feeder, each of the firs seaming chucks being insertable radially inwardly of the chuck wall, and a plurality of first holders disposed immediately above the first seaming chucks, respectively. The preliminary machining feeder is rotatable to rotate the barrel and the cover in a circumferential direction thereof while the barrel and the cover with the chuck wall inserted in the open end of the barrel are being rotatably held by each of the first seaming chucks and each of the first holders. A first seaming segment includes a preliminary fastening seaming groove and a preliminary necking-in jaw on an inner peripheral edge extending around the preliminary machining feeder and progressively approaching the flange of the barrel and the end hook of the cover as they are rotated by the preliminary machining feeder, for preliminarily fastening and necking in the barrel and the cover. A rotatable final machining feeder includes a plurality of second rotatable seaming chucks spaced circumferentially and radially equally from a center of rotation of the final machining feeder, each of the second seaming chucks is insertable radially inwardly of the chuck wall. A plurality of second holders are disposed immediately above the second seaming chucks, respectively. The final machining feeder is rotatable to rotate the barrel and the cover in a circumferential direction thereof, which have been preliminarily fastened and necked in by the preliminary machining feeder and the first seaming segment, while the barrel and the cover are being rotatably held by each of the second seaming chucks and each of the second holders. A second seaming segment includes a final fastening seaming groove and a final necking-in jaw on an inner peripheral edge extending around the final machining feeder and progressively approaching the flange of the barrel and the end hook of the cover as they are rotated by the final machining feeder, for finally fastening and necking in the barrel and the cover.

With the arrangement of the present invention, the first seaming segment and the end hook of the cover do not slip on each other to allow the first seaming segment to gradually press and deform the barrel and cover for preliminarily fasten and neck in the barrel and the cover.

Since the flange of the barrel and the end hook of the cover which have been preliminarily fastened together are further pressed and fastened together by the second seaming segment without slippage, the produced double seam does not have undesired defects, and the finalized necked-in portion of the barrel is free from wrinkles. Therefore, a necked-in container of good quality can be manufacured with high efficiency.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
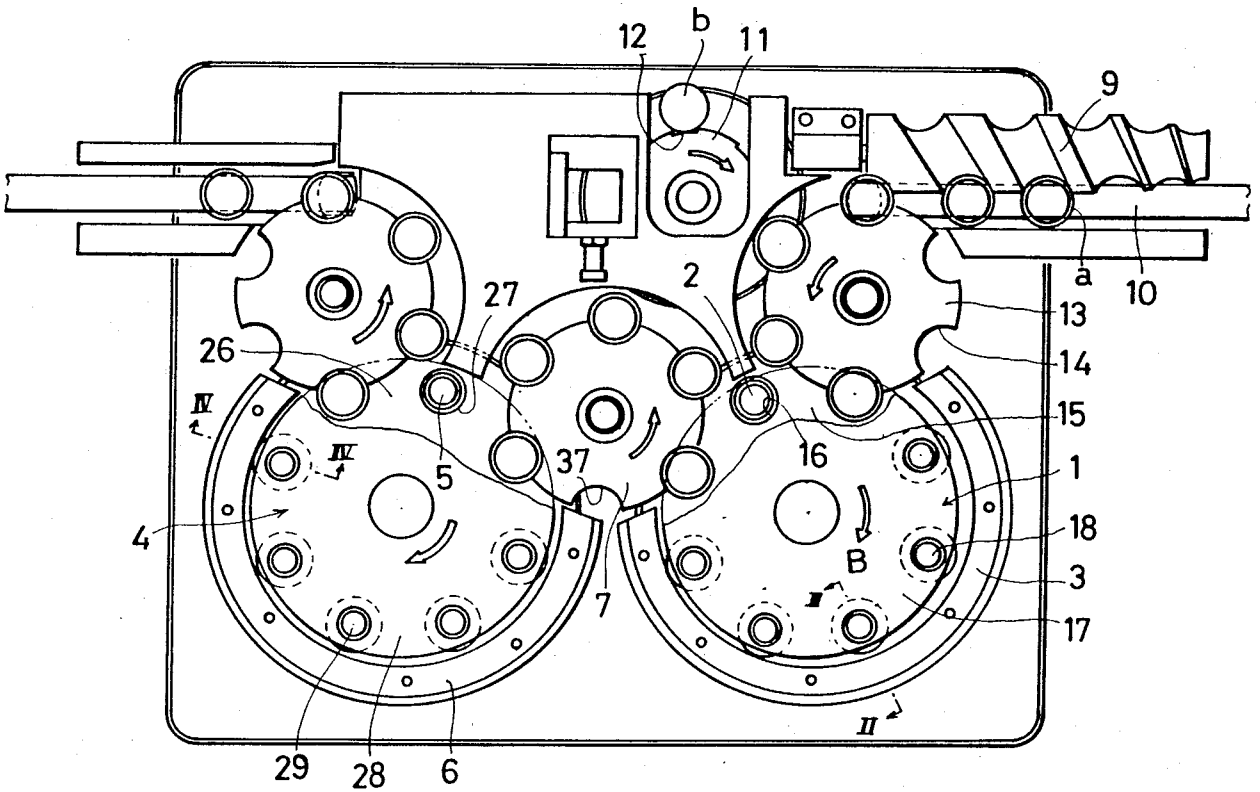
FIG. 1 is a plan view, partly broken away, of an apparatus according to the present invention.

As shown in FIG. 1, an apparatus for making metallic containers according to the present invention generally comprises a first feeder 1 for preliminary machining, a plurality of first rotatable seaming chucks 2, a first seaming segment 3, a second feeder 4 for final machining, a plurality of second rotatable seaming chucks 5, a second seaming segment 6, and a transfer unit 7.

Figure 8:
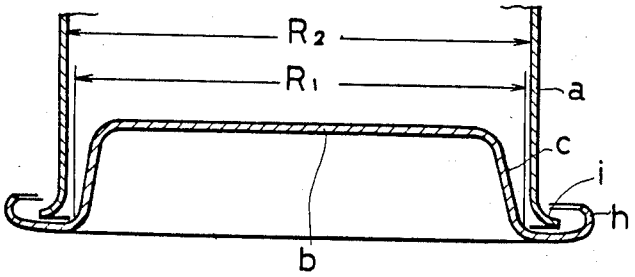
FIG. 8 is a fragmentary cross-sectional view of a barrel and a cover before they are fastened together.

Prior to describing the apparatus of FIG. 1 in detail, a barrel and a cover employed for making a necked-in container with the apparatus of the present invention will be described below. Before machining, as shown in FIG. 8, a barrel a is in the form of a hollow cylinder made of a thin metallic material such as tin-free steel, tinned steel, or the like, and has an open end including an annular flange i bent radially outwardly from the peripheral edge of the open end. The barrel a is of the same structure as that of the barrel of a conventional container. A cover b is made of the same thin material as that of the barrel a and includes a circular panel, an annular chuck wall c raised axially from the entire peripheral edge of the panel, and an annular hook h contiguous to the chuck wall c and curled radially inwardly. The chuck wall c has a maximum outside diameter R1 smaller than the inside diameter R2 of the barrel a.

The apparatus of the present invention will now be described in detail.

As shown in FIG. 1, a succession of barrels a are conveyed along a rail 10 by a screw conveyor 9 into the apparatus. A cover transfer feeder 11 is positioned at the end of the screw conveyor 9 and rotatable about its own axis with a plurality of covers b engaging in respective grooves 12. The barrels a supplied by the screw conveyor 9 are then delivered into respective recesses 14 defined at spaced intervals in the outer periphery of a barrel transfer feeder 13 which rotates about its own axis.

The covers b are successively moved by the cover transfer feeder 11 into a position immediately below the barrel transfer feeder 13 where the barrels a are also successively delivered thereby, so that a barrel a is positioned over a cover b in that position.

Figure 2:
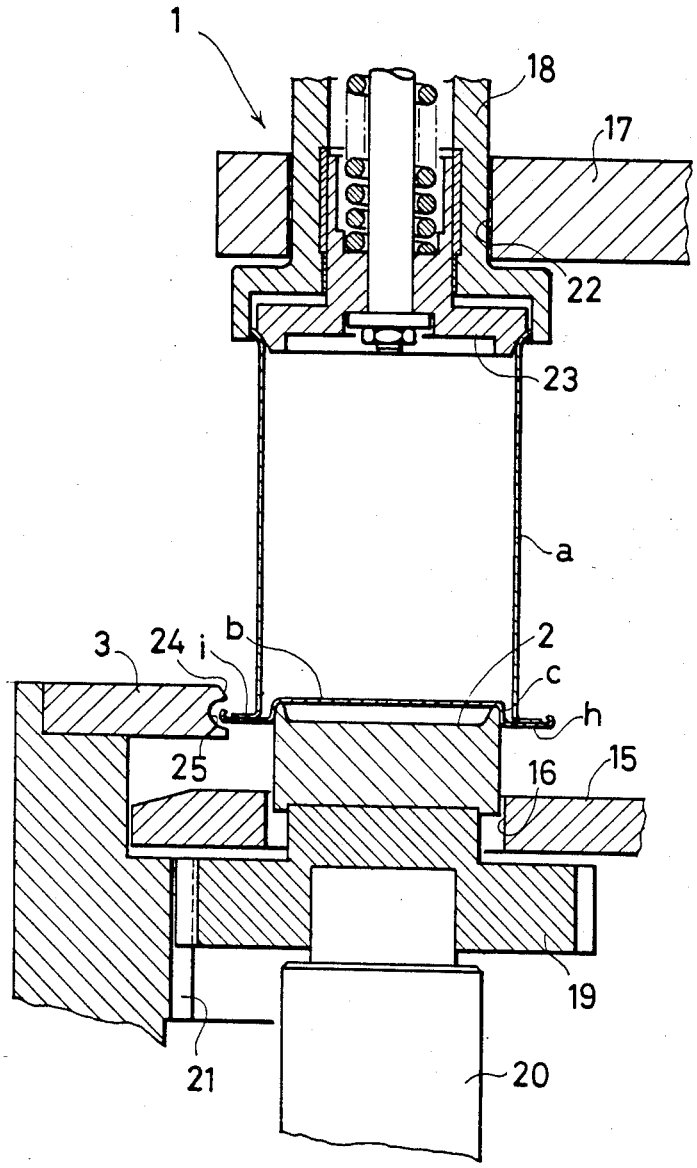
FIG. 2 is a fragmentary cross-sectional view taken along line II—II of FIG. 1.
Figure 3:
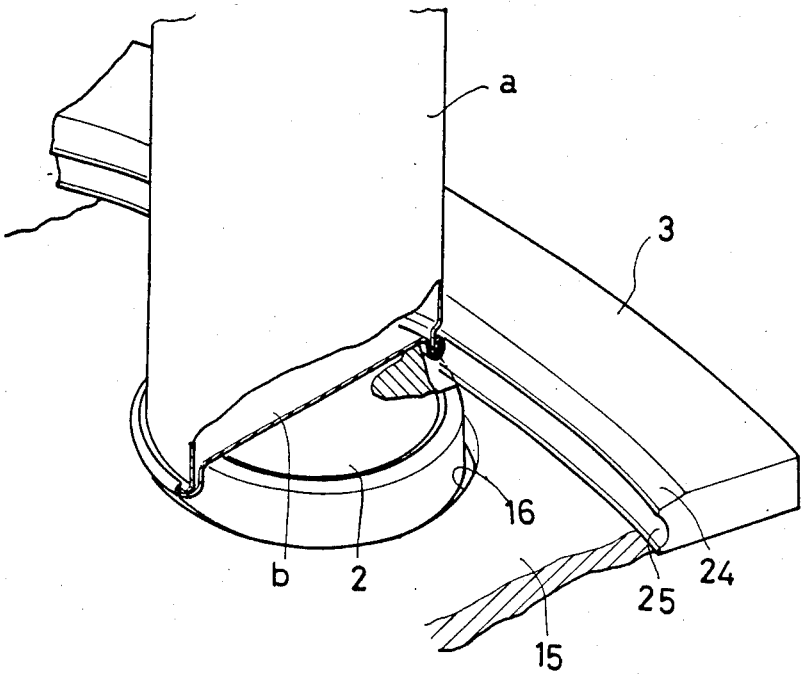
FIG. 3 is a fragmentary perspective view, partly broken away, showing the manner in which a barrel and a cover are fastened together by the apparatus of the invention.

As illustrated in FIGS. 1 through 3, the preliminary machining feeder 1 comprises a first circular rotatable plate 15 having a plurality of circumferentially spaced holes 16 defined therein and spaced radially equally from the center of the plate 15, the first seaming chuck 2 projecting upwardly respectively from the holes 16 and being movable in synchronism with the first rotatable plate 15, a first circular upper plate 17 positioned above and rotatable coaxially with the first rotatable plate 15, and a plurality of holders 18 supported on the first upper plate 17 and positioned immediately above the first seaming chucks 2, respectively.

As shown in FIG. 2, the first holders 18 and the first seaming chucks 2 are coaxially aligned in pairs for rotatably holding the barrels a with the covers b combined therewith in an erected condition.

More specifically, as shown in FIGS. 2 and 3, each of the first seaming chucks 2 has an outer peripheral surface complementary to the panel of the cover b and the inner peripheral surface of the chuck wall c. The first seaming chuck 2 is supported by a rotating member 19 on a lifter 20 and inserted in the hole 16 of the first rotatable plate 15. The first seaming chuck 2 is vertically movable by the lifter 20.

When the first seaming chuck 2 is raised from the hole 16 by the lifter 20, the upper end of the first seaming chuck 2 is positioned in a space defined and surrounded by the inner peripheral surface of the chuck wall c of the cover b. Each first seaming chuck 2 is moved with the first rotatable plate 15 by the corresponding lifter 20 which is rotated with the first rotatable plate 15. As illustrated in FIG. 2, the rotating member 19 between the first seaming chuck 2 and the lifter 20 is rotatably engageable and vertically slidable relative to an annular gear 21 positioned below the first seaming segment 3. Therefore, as the first rotatable plate 15 is rotated about its own axis, the rotating member 19 is also rotated about its own axis with the movement of the lifter 20, and so is the first seaming chuck 2.

As shown in FIG. 2, the first upper plate 17 rotatable coaxially with the first rotatable plate 15 is positioned in a location higher than the height of the barrels a. Each of the first holders 18 comprises a barrel chuck 23 inserted through one of a plurality of holes 22 defined in the first upper plate 17 in a circumferentially spaced relation and vertically aligned with the first seaming chucks 2, respectively. The barrel chuck 23 serves to resiliently hold an end flange of the barrel a when the barrel a is elevated with the first seaming chuck 2 by the lifter 20. The barrel chuck 23 is rotatable with the first seaming chuck 2 while the barrel chuck 23 is holding the barrel a.

Figure 5:
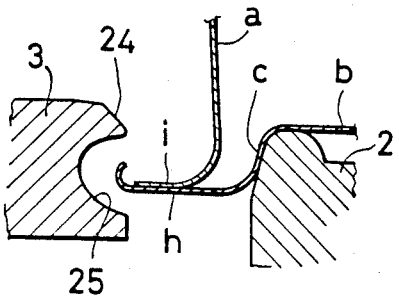
FIGS. 5, 6, and 7 are fragmentary cross-sectional views showing a preliminary fastening process carried out by the apparatus of the invention.
Figure 6:
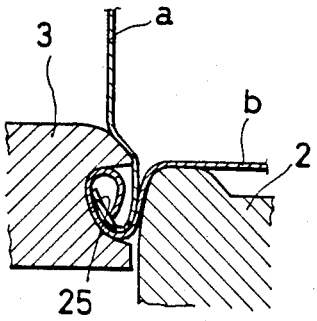

As shown in FIG. 1, the first seaming segment 3 is arcuate or horseshoe-shaped and detachably and adjustably secured around the preliminary machining feeder 1. The first seaming segment 3 has a first seaming groove 25 (FIGS. 2 and 3) defined in and along an inner peripheral surface thereof and having a first upper shoulder or jaw 24. The first seaming groove 25 has a cross-sectional shape as shown in FIGS. 5 and 6 from one end to the other of the first seaming segment 3 along the entire length of the inner peripheral surface thereof. The cross-sectional shape of the first seaming groove 25 is effective to cooperate with the first seaming chuck 2 in pressing and deforming the flange i of the barrel a and the end hook h of the cover b to preliminarily fasten them together. The first jaw 24 is pressed against a portion of the barrel a adjacent to the flange i to preliminarily neck in the barrel portion. In the illustrated embodiment, as shown in FIG. 1, the inner edge of the arcuate first seaming segment 3, i.e., the first seaming groove 25 and the first jaw 4, has its radius of curvature progressively smaller along the path of travel of the barrel a and the cover b as they are fed by the preliminary machining feeder 1. Specifically, the distance between the the flange i of the barrel a and the end hook h of the cover b, and the inner peripheral surface of the first seaming segment 3 is progressively larger upstream in the direction of the arrow B in which the preliminary machining feeder 1 rotates, and progressively smaller downstream in the direction of the arrow B.

Figure 4:
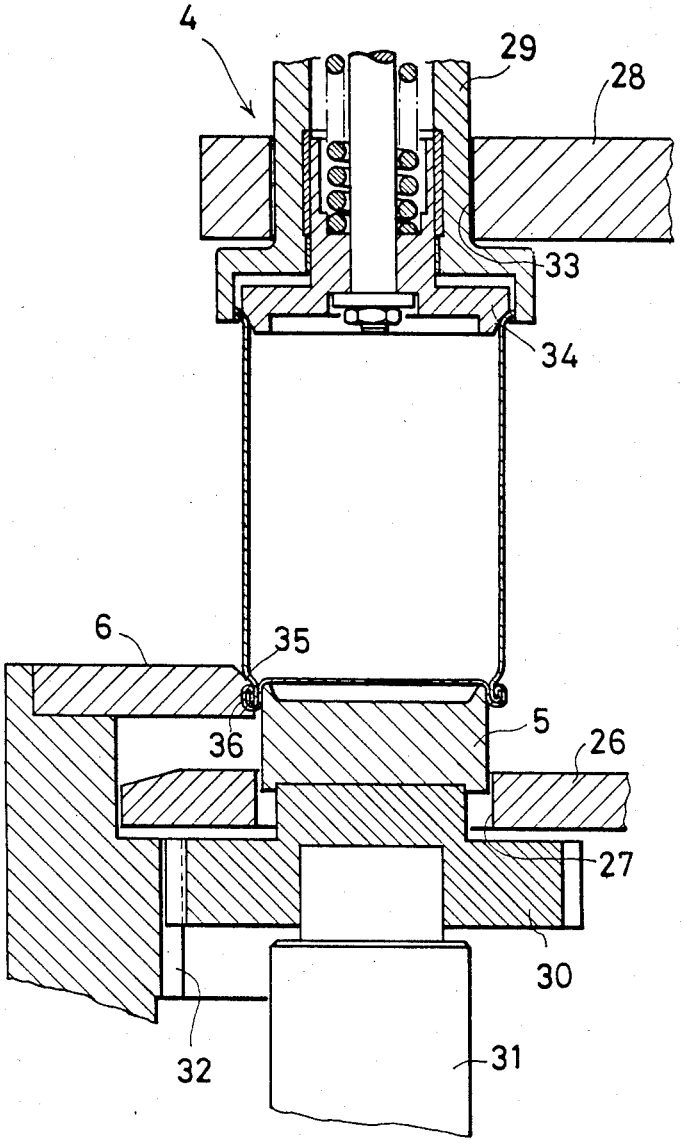
FIG. 4 is a fragmentary cross-sectional view taken along line IV—IV of FIG. 1.

The final machining feeder 4 is of substantially the same structure as that of the preliminary machining feeder 1. As shown in FIGS. 1 and 4, the final machining feeder 4 comprises a second circular rotatable plate 26 having a plurality of circumferentially spaced holes 27 defined therein and spaced radially equally from the center of the plate 26, the second seaming chuck 5 projecting upwardly respectively from the holes 27 and being movable in synchronism with the second rotatable plate 26, a second circular upper plate 28 positioned above and rotatable coaxially with the second rotatable plate 26, and a plurality of holders 29 supported on the second upper plate 28 and positioned immediately above the second seaming chucks 5, respectively.

As shown in FIG. 4, the second holders 29 and the second seaming chucks 5 are coaxially aligned in pairs for rotatably holding, in an erected condition, the barrels a that have been preliminarily fastened to the covers b and necked in by the first seaming chucks and the first seaming segment 3.

Figure 7:
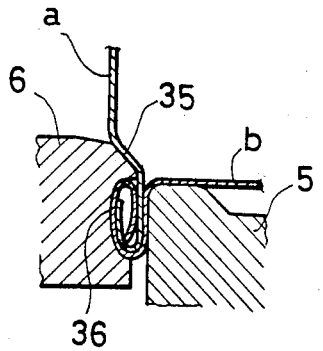

More specifically, as shown in FIGS. 4 and 7, each of the second seaming chucks 5 has an outer peripheral surface complementary to the inner peripheral surface of the chuck wall c of the cover b which has been preliminarily fastened to the barrel a. The second seaming chuck 5 is supported by a rotating member 30 on a lifter 31 and inserted in the hole 27 of the second rotatable plate 26. The second seaming chuck 5 is vertically movable by the lifter 31.

When the second seaming chuck 5 is elevated from the hole 27 by the lifter 31, the upper end of the second seaming chuck 5 is positioned in a space defined and surrounded by the inner peripheral surface of the preliminarily fastened chuck wall c of the cover b. Each second seaming chuck 5 is moved with the second rotatable plate 26 by the corresponding lifter 31 which is rotated with the second rotatable plate 26. As illustrated in FIG. 4, the rotating member 30 between the second seaming chuck 5 and the lifter 31 is rotatably engageable with and vertically movable relative to an annular gear 32 positioned below the second seaming segment 6. Therefore, as the second rotatable plate 26 is rotated about its own axis, the rotating member 31 is also rotated about its own axis with the movement of the lifter 31, and so is the second seaming chuck 5.

As shown in FIGS. 1 and 4, the second upper plate 28 rotatable coaxially with the second rotatable plate 26 is positioned in a location higher than the height of the barrels a. Each of the second holders 29 comprises a barrel chuck 34 inserted through one of a plurality of holes 33 defined in the second upper plate 28 in a circumferentially spaced relation and vertically aligned with the second seaming chucks 5, respectively. The barrel chuck 34 serves to resiliently hold an end flange of the barrel a when the barrel a is elevated with the second seaming chuck 5 by the lifter 31. The barrel chuck 34 is rotatable with the second seaming chuck 5 while the barrel chuck 34 is holding the barrel a.

As shown in FIG. 1, the second seaming segment 6 is arcuate or horseshoe-shaped and detachably and adjustably secured around the final machining feeder 4. The second seaming segment 6 has a second seaming groove 36 (FIGS. 4 and 7) defined in and along an inner peripheral surface thereof and having a second upper shoulder or jaw 35. The second seaming groove 36 has a cross-sectional shape as shown in FIG. 7 from one end to the other of the second seaming segment 6 along the entire length of the inner peripheral surface thereof. The cross-sectional shape of the second seaming groove 36 is effective to cooperate with the second seaming chuck 5 in pressing and deforming the flange i of the barrel a and the end hook h of the cover b that have been preliminarily fastened to finally fasten them together against the chuck wall c, thus forming a double seam. The second jaw 35 is pressed against the preliminarily necked-in portion of the barrel a to finalize the necked-in portion. As shown in FIG. 1, the inner edge of the arcuate second seaming segment 6, i.e., the second seaming groove 36 and the jaw 35, has its radius of curvature progressively smaller along the path of travel of the barrel a and the cover b as they are fed by the final machining feeder 1. Specifically, the distance between the the flange i of the barrel a and the end hook h of the cover b which have been fastened together, and the inner peripheral surface of the second seaming segment 6 is progressively larger upstream in the direction of rotation of the final machining feeder 4, and progressively smaller downstream in the same direction.

As illustrated in FIG. 1, the transfer unit 7 comprises a substantially circular plate rotatable about its own axis in a horizontal plane. The transfer unit 7 has a plurality of arcuate receiving recesses 37 defined in an outer peripheral edge at circumferentially spaced intervals and opening radially outwardly. The transfer unit 7 receives, in one of the receiving recesses 37, a barrel a with a cover b preliminarily fastened thereto from the preliminary machining feeder 1, after the cover b has been angularly moved through about 240 degrees thereby, and transfers the barrel a with the cover b to the final machining feeder 4.

Operation of the apparatus will now be described below.

In the position where the barrel transfer feeder 13 and the cover transfer feeder 11 meet each other (FIG. 1), the chuck wall c of a cover b is fitted upwardly into the open end of a barrel a, as shown in FIG. 8, and then the cover b is positioned on one of the first seaming chuck 2 of the preliminary machining feeder 1, with the upper end of the first seaming chuck 2 being held against the chuck wall c as shown in FIG. 5. Then, the lifter 20 is elevated to raise the first seaming chuck 2 near the first seaming segment 3 in confronting relation thereto, as shown in FIG. 2. The barrel a and the cover b are now held vertically by and between the first seaming chuck 2 and the corresponding first holder 18.

The preliminary machining feeder 1 is rotated to move the barrel a and the cover b therewith. The flange i of the barrel a and the end hook h of the cover b now approach the inner periphery of the first seaming segment 3. As the preliminary machining feeder 1 is continuously rotated, the distance between the first seaming chuck 2 and the first seaming segment 3 is progressively reduced, and the flange i of the barrel a and the end hook h of the cover b are progressively fastened together along the first seaming groove 25 by the first seaming chuck 2 as it presses the flange i and the end hook h against the first seaming segment 3. The end hook h is deformed by the first seaming groove 25 to enclose the flange i. The end hook h and the flange i are continuously deformed radially inwardly by the first seaming groove 25 as shown in FIG. 6, so that they are preliminarily fastened together. At the same time, the first jaw 24 deforms a portion of the barrel a near the open end thereof radially inwardly thereby to neck in the barrel a preliminarily.

The barrel a and the cover b which have thus been preliminarily deformed or machined are brought to the transfer unit 7, and then transferred thereby from the preliminary machining feeder 1 over to one of the second seaming chucks 5 of the final machining feeder 4 upon rotation of the transfer unit 7.

Figure 9:
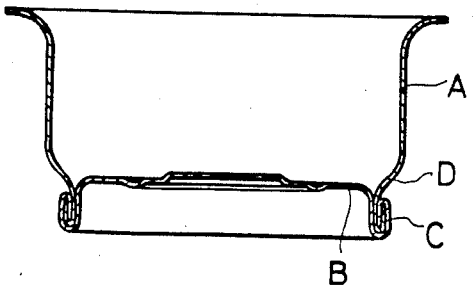
FIG. 9 is a cross-sectional view of a necked-in container produced by the apparatus of the invention.
Figure 10:
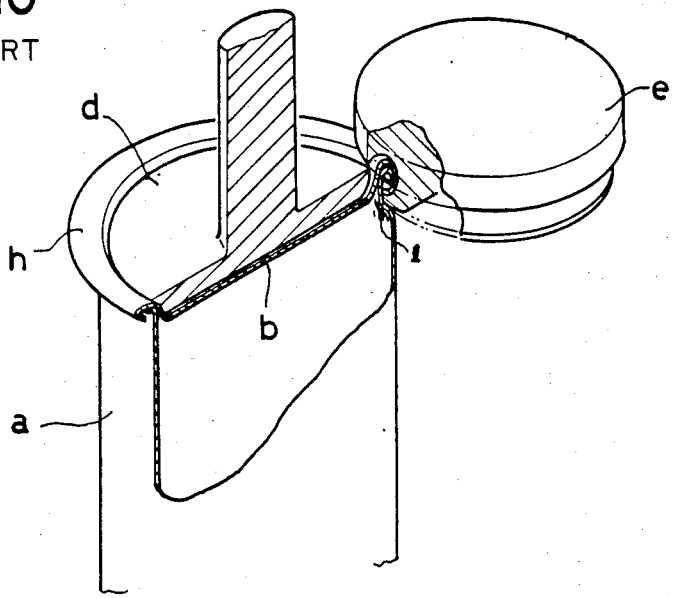
FIG.10 PRIOR ART
FIG. 10 is a fragmentary perspective view, partly cut away, illustrating a fastening process effected by a conventional apparatus.
Figure 11A:
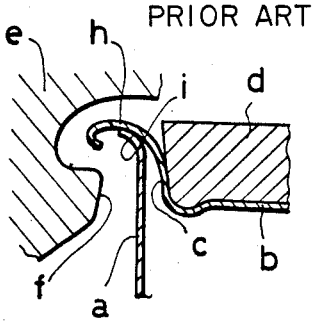
FIG.11(A) PRIOR ART
FIGS. 11(A) through 11(C) are fragmentary cross-sectional views explaining a conventional process.
Figure 11B:
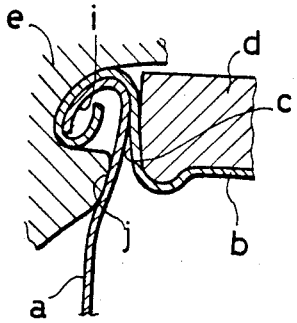
FIG. 11(B) PRIOR ART
Figure 11C:
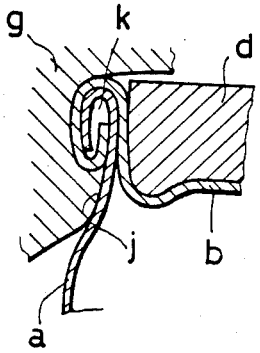
FIG. 11(C) PRIOR ART

As shown in FIG. 4, the upper end of the second seaming chuck 5 is held against the chuck wall c of the cover b which has been preliminarily fastened to the barrel a, and the lifter 31 is moved upwardly to elevate the preliminarily fastened portions of the barrel a and the cover b up to a position confronting the second seaming segment 6. The barrel a and the cover b are now held firmly by the second seaming chuck 5 and the corresponding second holder 29. Then, the final machining feeder 4 is rotated to move the barrel a and the cover b to bring the flange i and the end hook h toward the inner periphery of the second seaming segment 6. The distance between the second seaming chuck 5 and the second seaming segment 6 is progressively reduced to cause the second seaming segment 6 to fasten the flange i and the end hook h together. More specifically, as shown in FIGS. 4 and 7, the flange i and the end hook h are pressed by the second seaming groove 36 against the chuck wall c, thus providing a final double seam. Simultaneously, the preliminarily necked-in portion is finalized or finished by being pressed by the second jaw 35 against the chuck wall c. As shown in FIG. 9, a finished container thus includes a double seam C between a barrel A and a cover B and a necked-in portion D on the barrel A.

With the arrangement of the present invention, the first seaming segment 3 progressively approaches the preliminary machining feeder 1 along the circumferential direction thereof. Therefore, the barrel a and the cover b which are rotatably held by the first seaming chuck 2 and the first holder 18 are progressively moved toward the first seaming segment 3 and pressed thereagainst as the preliminary machining feeder 1 is rotated. Since the inner periphery of the arcuate first seaming segment 3 and the circular cover b contact each other gradually linearly, the barrel a and the cover b are preliminarily fastened together and at the same time are necked in. Sufficient friction takes place between the first seaming segment 3 and the cover b as it is fastened to the barrel a while in rotation. The first seaming segment 3 and the cover b are thus prevented from slipping for facilitating preliminary fastening and necking-in of the barrel a and the cover b.

Similarly, the second seaming segment 6 progressively approaches the final machining feeder 4 along the periphery thereof. Accordingly, the barrel a and the cover b which are held between the second seaming chuck 6 and the second holder 29 and that have been preliminarily fastened and necked in are displaced progressively toward and pressed against the second seaming segment 6 while moving in the circumferential direction of the final machine feeder 4.

Consequently, the inner periphery of the arcuate second seaming segment 6 and the barrel a contact each other linearly to finally fasten and neck in the barrel a and the cover b progressively. The cover b and the second seaming segment 6 are prevented from slipping with respect to each other because of sufficient friction produced therebetween. The finished container thus has a necked-in portion and a double seam which are finalized without any unwanted defects.

The distance between the preliminary machining feeder 1 and the first seaming segment 3 and the distance between the final machining feeder 4 and the second seaming segment 6 are freely adjustable to easily adjust the pressures applied by the first and second seaming chucks 2, 5 to the first and second seaming segments 3, 6, respectively.

The above pressure adjustability is advantageous in that during the fastening and necking-in process, slippage between the cover b and the first and second seaming chucks 2, 5 can effectively be prevented to avoid defects which might otherwise be produced in the fastened barrel a and the cover b, and to deeply neck in the barrel a and the cover b. It is easy to make adjustments to prevent slippage between the cover b and the first and second seaming chucks 2, 5 during the fastening and necking-in process, so that wear on the first and second seaming segments 3, 6 can largely be reduced and hence these segments can be used for a long period of time.

Although a certain preferred embodiment has been shown and described, it should be understood that many changes and modifications may be made therein without departing from the scope of the appended claims.

What is claimed is:

1. An apparatus for manufacturing a container including a barrel having an open end with a flange a cover having a panel, a cylindrical chuck wall raised from said panel and having an outside diameter smaller than the inside diameter of said barrel, and an end hook contiguous to said chuck wall, said chuck wall being inserted in said open end of the barrel, said flange and said end hook being fastened by a double seam, said barrel and said cover being necked-in adjacent to said double seam, said apparatus comprising:

a rotatable preliminary machining feeder including a plurality of first rotatable seaming chucks spaced circumferentially and radially equally from a center of rotation of the preliminary machining feeder, each of said first seaming chucks being insertable radially inwardly of said chuck wall, and a plurality of first holders disposed immediately above said first seaming chucks, respectively, said preliminary machining feeder being rotatable to rotate the barrel and the cover in a circumferential direction thereof while said barrel and said cover with the chuck wall inserted in the open end of the barrel are being rotatably held by each of said first seaming chucks and each of said first holders;

a first seaming segment having a preliminary fastening seaming groove and a preliminary necking-in jaw on an inner peripheral edge extending around said preliminary machining feeder and progressively approaching the flange of said barrel and the end hook of said cover as they are rotated by said preliminary machining feeder, for preliminary fastening and necking-in said barrel and said cover, said preliminary fastening seaming groove and said preliminary necking-in jaw of said first seaming segment have radii of curvature progressively smaller along a path of travel of said barrel and said cover which are fed by said preliminary machining feeder;

a rotatable final machining feeder including a plurality of second rotatable seaming chucks spaced circumferentially and radially equally from a center of rotation of the final machining feeder, each of said second seaming chucks being insertable radially inwardly of said chuck wall, and a plurality of second holders disposed immediately above said second seaming chucks, respectively, said final machining feeder being rotatable to rotate the barrel and the cover in a circumferential direction thereof, which have been preliminarily fastened and necked-in by said preliminary machining feeder and said first seaming segment, while said barrel and said cover are being rotatably held by each of said second seaming chucks and each of said second holders; and a second seaming segment having a final fastening seaming groove and a final necking-in jaw on an inner peripheral edge extending around said final machining feeder and progressively approaching the flange of said barrel and the end hook of said cover as they are rotated by said final machining feeder, for finally fastening and necking-in said barrel and said cover, said final fastening seaming groove and said final necking-in jaw of said second seaming segment have radii of curvature progressively smaller along a path of travel of said barrel and said cover which are fed by said final machining feeder.

2. An apparatus according to claim 1, wherein said preliminary machining feeder comprises a first rotatable circular plate, and a first upper circular plate disposed above and rotatable coaxially with said first rotatable circular plate, said first seaming chucks being mounted on said first rotatable circular plate in circumferentially equally spaced relation, said first holders being mounted on said first upper circular plate in vertical alignment with said first seaming chucks, respectively.

3. An apparatus according to claim 1, wherein said first seaming chucks are movable with respect to said first holders.

4. An apparatus according to claim 2, wherein said preliminary fastening seaming groove and said preliminary necking-in jaw of said first seaming segment are positioned between said first rotatable circular plate and said first upper circular plate.

5. An apparatus according to claim 1, wherein said final machining feeder comprises a second rotatable circular plate, and a second upper circular plate disposed above and rotatable coaxially with said second rotatable circular plate, said second seaming chucks being mounted on said second rotatable circular plate in circumferentially equally spaced relation, said second holders being mounted on said second upper circular plate in vertical alignment with said second seaming chucks, respectively.

6. An apparatus according to claim 1, wherein said second seaming chucks are movable with respect to said second holders.

7. An apparatus according to claim 5, wherein said final fastening seaming groove and said final necking-in jaw of said second seaming segment are positioned between said second rotatable circular plate and said second upper circular plate.

8. An apparatus according to claim 1, further including a transfer unit for transferring said barrel and said cover which have been preliminarily fastened and necked in by said preliminary machining feeder and said first seaming segment to said final machining feeder.

* * * * *